US006447966B1

(12) United States Patent
Yagi et al.

(10) Patent No.: US 6,447,966 B1
(45) Date of Patent: Sep. 10, 2002

(54) ELECTROPHOTOGRAPHIC PHOTOSENSITIVE BODY AND WET ELECTROPHOTOGRAPHIC APPARATUS

(75) Inventors: Hitoshi Yagi, Yokohama; Masahiro Hosoya, Okegawa; Koichi Ishii, Kawasaki, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/521,900

(22) Filed: Mar. 9, 2000

(30) Foreign Application Priority Data

Mar. 11, 1999 (JP) ..... 11-064170

(51) Int. Cl.[7] ..... G03G 5/147; G03G 15/10

(52) U.S. Cl. ..... 430/67; 430/66; 399/159; 399/233

(58) Field of Search ..... 430/56, 66, 67, 430/59.6, 96, 117, 58.2; 399/159, 233, 237

(56) References Cited

U.S. PATENT DOCUMENTS

| | | | | |
|---|---|---|---|---|
| 4,600,673 A | | 7/1986 | Hendrickson et al. | 430/66 |
| 4,997,738 A | * | 3/1991 | Kumakura et al. | 430/67 |
| 5,278,615 A | * | 1/1994 | Landa | 399/237 |
| 5,283,143 A | * | 2/1994 | Yanus et al. | 430/56 |
| 5,324,609 A | | 6/1994 | Yagi et al. | 430/66 |
| 5,652,078 A | | 7/1997 | Jalbert et al. | 430/67 |
| 5,733,698 A | | 3/1998 | Lehman et al. | 430/66 |
| 6,146,804 A | * | 11/2000 | Miyamoto et al. | 430/117 |
| 6,248,489 B1 | * | 6/2001 | Yagi et al. | 430/66 |

FOREIGN PATENT DOCUMENTS

| | | |
|---|---|---|
| JP | 6-083097 | 3/1994 |
| JP | 10-069117 | 3/1998 |

OTHER PUBLICATIONS

L. J. Bresina, et al., "Process Control in Liquid Electrophotography for Critical Color Halftone Digital Proofing", IS&T's Eighth International Congress on Advances in Non–Impact Printing Technologies, 1992, pp. 215–218.

* cited by examiner

*Primary Examiner*—Janis L. Dote
(74) *Attorney, Agent, or Firm*—Oblon, Spivak, McClelland, Maier & Neustadt, P.C.

(57) ABSTRACT

This invention is to provide an electrophotographic photosensitive body used in a wet electrophotographic apparatus and including a substrate having a conductive surface, and a photosensitive layer formed on the conductive surface of the substrate and changing in a charged state upon being irradiated with light, the photosensitive layer having, on an exposed surface, C—F bonds and C—H bonds for which the ratio of the number $N_{CF}$ of C—F bonds to the number $N_{CH}$ of C—H bonds satisfies, on the exposed surface of the photosensitive layer, a relationship represented by $$2/100<N_{CF}/N_{CH}<300/100,$$

and a wet electrophotographic apparatus using the electrophotographic photosensitive body.

22 Claims, 3 Drawing Sheets

ELECTROPHOTOGRAPHIC PHOTOSENSITIVE BODY AND WET ELECTROPHOTOGRAPHIC APPARATUS

CROSS-REFERENCE TO RELATED APPLICATION

This application is based upon and claims the benefit of priority from the prior Japanese Patent Application No. 11-064170, filed Mar. 11, 1999, the entire contents of which are incorporated herein by reference.

BACKGROUND OF THE INVENTION

The present invention relates to an electrophotographic photosensitive body and electrophotographic apparatus and, more particularly, to an electrophotographic photosensitive body and electrophotographic apparatus used in a wet electrophotographic technology.

In an electrophotographic technology, the transfer efficiency of toner is an important factor that determines the image quality. For example, if a transfer efficiency of 100% is not realized, i.e., toner is not completely transferred onto paper, the degradation in image quality appears as a decrease in image density or an image blur. If the transfer efficiency from a photosensitive body such as a photosensitive drum to paper or an intermediate transfer roller is low, the amount of toner remaining on the image holding surface of the photosensitive body after transfer is large, and a more powerful cleaner must be used. As a result, the image holding surface of the photosensitive body is considerably damaged by the cleaner, resulting in a shorter life time of the photosensitive body. Hence, a demand for realizing a sufficiently high transfer efficiency, i.e., a transfer efficiency of almost 100% has arisen.

As electrophotography, currently, dry electrophotography is popular. In dry electrophotography, as a developer, a single component developer made of toner particles containing ferrite or a dual component developer made of a mixture of carrier particles of ferrite and toner particles is used. That is, this technology uses a developing powder.

Since such a developing powder is used in dry electrophotography, the problem associated with the transfer efficiency is relatively simple. For example, in this technology, a sufficient transfer efficiency has already been realized by improving the transfer process or decreasing the adhesion between the image holding surface of the photosensitive body and the developing powder.

To the contrary, in wet electrophotography, a liquid developer formed by dispersing toner particles into a petroleum solvent is used as a developer. For this reason, as will be described below, the problem associated with the transfer efficiency in wet electrophotography is much more complex than that in dry electrophotography.

In wet electrophotography, toner having a particle diameter on the submicron order is used, which is much smaller than the particle diameter of toner used in dry electrophotography. For this reason, wet electrophotography is expected to realize a higher image quality. In addition, since a sufficient image density can be obtained in a small amount of toner, wet electrophotography is expected to be economical and realize the texture of printing (e.g., offset printing). Furthermore, since toner can be fixed to paper at a relatively low temperature, wet electrophotography is expected to realize energy saving.

However, when toner having such small particle diameter is dispersed into a petroleum solvent, although the above-described advantages are expected, the adhesion between the image holding surface of the photosensitive body and the developer eminently increases. For this reason, if a developer image is to be transferred by an electric field transfer scheme, i.e., using electrophoresis of toner particles in the petroleum solvent, a large potential difference must be applied between the photosensitive body and the transfer roller and the like. However, normally, such large potential difference can not be applied. Hence, in wet electrophotography, a sufficient transfer efficiency can hardly be realized using only the electric field transfer scheme.

In wet electrophotography, not the electric field transfer scheme but the offset transfer scheme using heat or pressure to transfer a developer image can be used. When this scheme is employed, a high transfer efficiency can be realized by coating the image holding surface of the photosensitive body with a silicone resin or fluororesin. However, when a silicone resin or fluororesin is only simply applied to the image holding surface of the photosensitive body, an image omission, i.e., partial omission of the developer image on the image holding surface, or a so-called image blur in which the toner forming the developer image extends outward from the electrostatic latent image may occur. If the developer image is distorted, no satisfactory image quality can be obtained anymore.

The image blur readily occurs when the amount of solvent remaining on the image holding surface is large. To prevent this, an examination has been made to remove the excess solvent from the image holding surface of the photosensitive body before transfer, but the obtained effect is still insufficient.

As described above, in wet electrophotography, when the image holding surface of the photosensitive body is modified to improve the transfer efficiency, an image omission or an image blur must be taken into consideration. Unlike dry electrophotography, the adhesion between the image holding surface of the photosensitive body and the developer is influenced by not only the interaction between the powder and the image holding surface of the photosensitive body but also the interaction between the solvent and the image holding surface of the photosensitive body.

More specifically, since the developer used in wet electrophotography contains the solvent, the influence of the solvent on the adhesion between the image holding surface of the photosensitive body and the developer must be taken into consideration. In addition, an image omission or image blur that need not be taken into consideration in dry electrophotography must also be taken into consideration. For these reasons, wet electrophotography can hardly realize a satisfactory image quality.

BRIEF SUMMARY OF THE INVENTION

It is an object of the present invention to provide an electrophotographic photosensitive body and wet electrophotographic apparatus, which can realize a satisfactory image quality in wet electrophotography.

It is another object of the present invention to provide an electrophotographic photosensitive body and wet electrophotographic apparatus, which can realize a sufficiently high transfer efficiency in wet electrophotography without causing any image omission or image blur.

According to the first aspect of the present invention, there is provided an electrophotographic photosensitive body used in a wet electrophotographic apparatus, comprising a substrate having a conductive surface, and a photosensitive layer formed on the conductive surface of the substrate and changing in a charged state upon being irradiated with light, the photosensitive layer having, on an exposed surface, C—F bonds and C—H bonds for which the ratio of the number $N_{CF}$ of C—F bonds to the number $N_{CH}$ of C—H bonds satisfies, on the exposed surface of the photosensitive layer, a relationship represented by $$2/100<N_{CF}/N_{CH}<300/100.$$

According to the second aspect of the present invention, there is provided a wet electrophotographic apparatus comprising an electrophotographic photosensitive body having an image holding surface comprising a substrate having a conductive surface, and a photosensitive layer formed on the conductive surface of the substrate and changing in a charged state upon being irradiated with light, an exposed surface of the photosensitive layer constituting the image holding surface, C—F bonds and C—H bonds existing on the image holding surface for which the ratio of the number $N_{CF}$ of C—F bonds to the number $N_{CH}$ of C—H bonds satisfies, on the image holding surface, a relationship represented by $$2/100<N_{CF}/N_{CH}<300/100$$

a latent image formation unit forming a latent image on the image holding surface, a developing unit forming a developer image on the image holding surface having the latent image using a liquid developer, and a transfer unit transferring the developer image from the image holding surface onto a recording medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
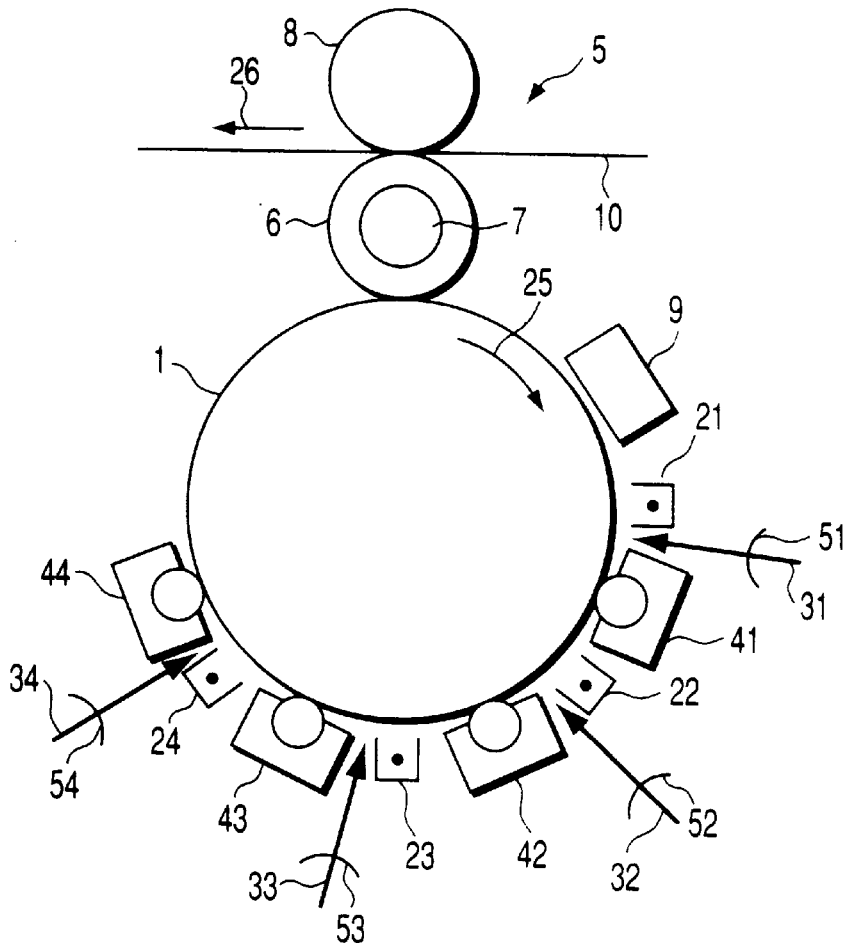
FIG. 1 is a view schematically showing a wet electrophotographic apparatus according to an embodiment of the present invention.

The present invention will be described below in more detail with reference to the accompanying drawing. The same reference numerals denote the same members throughout the drawings, and a detailed description thereof will be omitted.

FIG. 1 is a view schematically showing a wet electrophotographic apparatus according to an embodiment of the present invention. The wet electrophotographic apparatus shown in FIG. 1 is a full color wet electrophotographic apparatus which forms an electrophotographic image using liquid developers of yellow, magenta, cyan, and black.

The wet electrophotographic apparatus shown in FIG. 1 has a photosensitive body 1 such as a photosensitive drum. A cleaner 9 for cleaning the image holding surface of the photosensitive body 1, chargers 21 to 24, developing devices 41 to 44, and a transfer unit 5 are arranged around the photosensitive body 1. The constituent elements of the wet electrophotographic apparatus shown in FIG. 1 will be described in more detail.

The photosensitive body 1 has a substrate having a conductive surface, and a photosensitive layer formed on the conductive surface. The photosensitive layer has an image holding surface and contains, e.g., an organic photosensitive material, or amorphous-silicon-, SeTe-, or zinc-oxide-based photosensitive material that changes the charged state by light irradiation. The photosensitive layer can be charged to the positive or negative polarity by a charger 2–n such as a corona charger represented by a corotoron charger or scorotoron charger.

The photosensitive body 1 having the above arrangement is rotated in a direction indicated by an arrow 25 by a driving mechanism (not shown), as shown in FIG. 1. Accordingly, the image holding surface of the photosensitive body 1 moves relative to the cleaner 9, chargers 21 to 24, developing devices 41 to 44, and transfer unit 5. The structure of the photosensitive body 1 will be described later in detail.

An optical system unit having laser exposure devices and light sources such as LEDs (not shown) is arranged around the photosensitive body 1 as an image writing unit. For example, the image holding surface of the photosensitive body 1 charged to a predetermined polarity by the chargers 21 to 24 is exposed with laser beams 31 to 34 irradiated through window portions 51 to 54. The exposed portion and non-exposed portion have a difference in surface electric potential, and electrostatic latent images corresponding to yellow, magenta, cyan, and black image information are formed on the image holding surface. The latent image formation unit is constructed by the image writing unit and the above-described chargers.

Each of the developing devices 41 to 44 supplies a liquid developer containing toner and a solvent, i.e., a developer solution to the image holding surface of the photosensitive body 1 on which the electrostatic latent images are formed. Each of the developing devices 41 to 44 normally has a vessel storing the developer solution, a developing roller spaced apart from the image holding surface by a small gap to supply the developer solution to the image holding surface of the photosensitive body 1, and a voltage application mechanism for applying a voltage to the developing roller.

The developing devices 41 to 44 form developer images on the image holding surface of the photosensitive body 1 in patterns corresponding to the electrostatic latent images. The developing devices 41 to 44 and latent image formation units are alternately arranged around the photosensitive body 1. More specifically, according to the electrophotographic apparatus shown in FIG. 1, yellow, magenta, cyan, and black developer images can be sequentially formed on the image holding surface of the photosensitive body 1.

The transfer unit 5 has an intermediate transfer medium, such as a transfer roller 6, and a press roller 8. The transfer roller 6 is in contact with the photosensitive body 1, to which pressure is applied from the press roller 8 through a paper sheet 10 as a recording medium. The transfer roller 6 normally incorporates a heater 7 which makes the adhesion of the developer to the transfer roller 6 stronger than that to the photosensitive body 1. In the transfer unit 5, the transfer roller 6 is not an essential constituent element. That is, the transfer unit 5 can be constructed only by the press roller 8.

As described above, the transfer unit 5 preferably employs offset transfer using pressure. However, it can employ electric field transfer as well. When electric field transfer is employed, a voltage application mechanism applying a predetermined voltage to the transfer roller 6 is used.

The process of forming an electrophotographic image using the wet electrophotographic apparatus shown in FIG. 1 will be described below. The electrophotographic image formation process using the wet electrophotographic apparatus shown in FIG. 1 is performed while rotating the photosensitive body 1 in the direction indicated by the arrow 25. First, the image holding surface cleaned by the cleaner 9 reaches the front of the charger 21 as the photosensitive body 1 rotates, and is uniformly charged to a positive or negative polarity.

Next, the image holding surface charged by the charger 21 is sent to the front of the window portion 51 as the photosensitive body 1 rotates. The charged image holding surface is exposed with the laser beam 31 from the laser exposure device (not shown) through the window portion 51 in correspondence with yellow image information. As a consequence, charges at the exposed portion of the image holding surface are removed to form an electrostatic latent image corresponding to the yellow image information on the image holding surface.

The image holding surface having the yellow electrostatic latent image is sent to the developing device 41 as the photosensitive body 1 rotates. A yellow liquid developer containing yellow toner and a solvent is supplied to the image holding surface that has reached the developing device 41. At this time, a predetermined bias voltage having the same polarity as the charge polarity of the toner is applied to the developing roller. An electric field is applied to in the liquid developer which is supplied to the gap between the image holding surface and the developing roller. The toner moves to the image holding surface of the photosensitive body 1 by electrophoresis. As a result, a yellow developer image is formed on the image holding surface of the photosensitive body 1.

Note that the liquid developer used at this time contains, e.g., 1 to 10 wt % of toner and a solvent. As toner particles, particles prepared by mixing an acrylic copolymer and pigment can be used. As the solvent, a high-resistant or insulating petroleum solvent such as ISOPAR or NORPAR available from Exxon can be used.

After the yellow developer image is formed on the image holding surface, magenta, cyan, and black developer images are sequentially formed following the same procedures as described above. After that, a transfer process to be described below is executed.

First, the paper sheet 10 is inserted between the transfer roller 6 and the press roller 8. The transfer roller 6 is heated by the heater 7 to a relatively low temperature of, e.g., about 40° C. to 60° C. The photosensitive body 1, transfer roller 6, and press roller 8 are rotated to bring the developer images formed on the image holding surface into contact with the surface of the transfer roller 6, and a weight of, e.g., 50 kg is applied by the press roller 8, thereby transferring the developer images from the image holding surface of the photosensitive body 1 onto the transfer roller 6. Alternatively, by applying a voltage having an opposite polarity to the polarity of the toner to the transfer roller 6, the developer images are transferred from the image holding surface of the photosensitive body 1 onto the transfer roller 6 by the electrostatic attraction with respect to the transfer roller 6.

The developer images transferred onto the transfer roller 6 move as the transfer roller 6 rotates, and come into contact with the paper sheet 10. Since pressure is applied from the press roller 8 to the transfer roller 6, the developer images are transferred from the surface of the transfer roller 6 onto the paper sheet 10. The paper sheet 10 moves in the direction indicated by an arrow 26 as the transfer roller 6 rotates, and the developer images transferred onto the transfer roller 6 are continuously transferred onto the paper sheet 10. In many cases, wet electrophotography can execute the fixing process at room temperature. However, images may be thermally fixed by heating the press roller 8 in transferring the developer images to the paper sheet 10. In the above-described way, a full-color electrophotographic image can be formed on the paper sheet 10.

As a characteristic feature of the above-described wet electrophotographic apparatus, C—F bonds and C—H bonds exist at a predetermined ratio on the image holding surface of the photosensitive body 1. The photosensitive body 1 will be described below in more detail.

Figure 2:
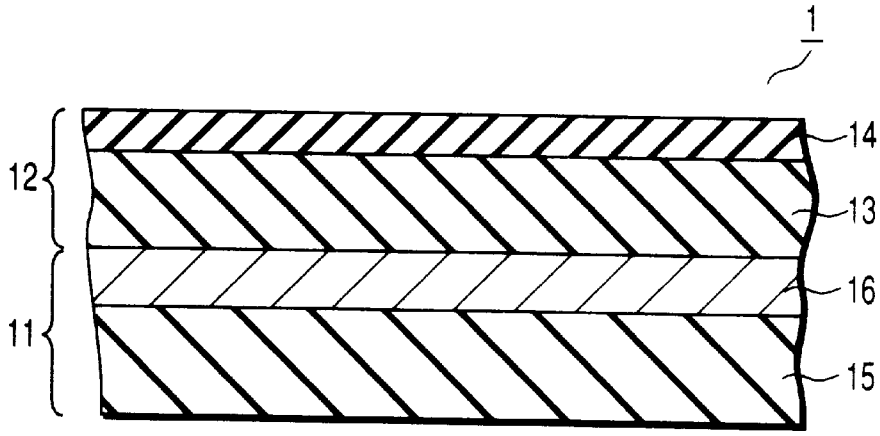
FIG. 2 is a sectional view schematically showing an electrophotographic photosensitive body used in the wet electrophotographic apparatus shown in FIG. 1.

FIG. 2 is a sectional view showing an example of the photosensitive body 1 used in the wet electrophotographic apparatus shown in FIG. 1. The photosensitive body 1 shown in FIG. 2 has a substrate 11 having a conductive surface and a photosensitive layer 12 formed on the conductive surface of the substrate 11.

As shown in FIG. 2, the substrate 11 can have a structure in which a conductive film 16 is formed on the surface of an insulating substrate 15 formed from an insulating material such as polyethylene. Alternatively, the substrate 11 may be formed from only a conductive substrate of a conductive material such as Al.

The photosensitive layer 12 can be charged to a positive or negative polarity by the above-described chargers 21 to 24 and contains an organic or an inorganic photosensitive material. In addition, C—F bonds and C—H bonds exist on the surface of the photosensitive layer 12. That is, at least the surface region of the photosensitive layer 12 contains a chemical substance different from a photosensitive material.

The photosensitive layer 12 can have a single-layered structure in which the chemical substance and photosensitive material are mixed. Normally, the photosensitive layer 12 has a structure in which a photoconductive layer 13 containing a photosensitive material and a surface layer 14 containing the chemical substance are sequentially stacked on the conductive surface of the substrate 11, as shown in FIG. 2. When the photosensitive layer 12 has a multilayered structure as shown in FIG. 2, contamination of the photoconductive layer 13 can be prevented. In this case, degradation due to contact between the photoconductive layer 13 and the solvent contained in the developer solution can be prevented. Note that the surface layer 14 has an image holding surface.

To realize a sufficiently high transfer efficiency without any image omission or image blur, the present inventors have paid attention to the fact that when C—F bonds or C—H bonds are made to exist on the image holding surface, the releasability can be increased, and the effect is larger in the presence of C—F bonds than in the presence of C-v bonds. On the basis of this fact, the present inventors examined the influence of the ratio $N_{CF}/N_{CH}$ of the number $N_{CF}$ of C—F bonds to the number $N_{CH}$ of C—H bonds on the transfer efficiency and occurrence of an image omission or image blur . As a result, the present inventors have found that the influence of the ratio $N_{CF}/N_{CH}$ on the transfer efficiency and occurrence of the image omission or image blur is very large, and the above problem can be very effectively solved by introducing C—F bonds and C—H bonds in the surface layer 14 in such a way that a relationship represented by $$2/100<N_{CF}/N_{CH}<300/100$$

is satisfied.

When the ratio $N_{CF}/N_{CH}$ o n the image holding surface is 2/100 or more, the adhesion between the image holding surface and the developer image is decreased. For this reason, the transfer efficiency can be largely improved. In this case, since the wetting properties of the solvent remainingein the developer image with respect to the image holding surface conspicuously degrade, an image blur caused by the remaining solvent can be suppressed.

As the ratio $N_{CF}/N_{CH}$ on the image holding surface becomes high, a high transfer efficiency is obtained. However, when the ratio $N_{CF}/N_{CH}$ is 300/100 or more, no sufficient image quality can be obtained. The reason for this is as follows. When the ratio $N_{CF}/N_{CH}$ is 300/100 or more, the surface tension (repelling force) acting between the liquid developer and the image holding surface of the photosensitive body becomes excessively larger than the electrostatic force acting between the toner in the liquid developer and the image holding surface of the photosensitive body, and the developer image is omitted or an image blur occurs on the image holding surface.

When the ratio $N_{CF}/N_{CH}$ is larger than 2/100 and smaller than 300/100, a sufficiently high transfer efficiency can be realized without causing any image omission or image blur. The ratio $N_{CF}/N_{CH}$ preferably satisfies a relationship represented by $$5/100<N_{CF}/N_{CH}<100/100.$$

In this case, a higher transfer efficiency can be realized, and an image omission and image blur can be properly prevented.

The above-described surface layer 14 can be formed by, e.g., the following method. First, a coating solution containing a compound such as silicone that has C—H bonds but no F atoms and a fluorine compound such as fluoroalkylsilane having C—F bonds but no C—H bonds is prepared. Next, this coating solution is applied to the surface of the photoconductive layer 13 by dip coating method. The solvent is removed from the coating solution applied to the surface of the photoconductive layer 13. The resultant compound is heated to obtain the surface layer 14. At least some part of fluoroalkylsilane contained in the coating solution form siloxane bonds upon heating and becomes fluorosilicone resin. Hence, the resultant surface layer 14 contains silicone resin and fluorosilicone resin.

In place of such a coating solution, a coating solution containing a polymer having C atoms, F atoms, and H atoms, preferably a compound such as fluorosilicone having both C—H bonds and C—F bonds may be used. In this case, however, the condition associated with the ratio $N_{CF}/N_{CH}$ must be satisfied even in fluorosilicone. Hence, to form the surface layer 14, a mixed solution containing silicone that has C—H bonds but no F atoms and a fluorine compound having C—F bonds is preferably used. In this case, a desired ratio $N_{CF}/N_{CH}$ can be easily realized by appropriately controlling the mixture ratio.

To realize a desired ratio $N_{CF}/N_{CH}$ using a coating solution prepared by mixing two or more compounds, the ratio $N_{CF}/N_{CH}$ need to be different among the compounds. Also, a coating solution containing a compound that has C—H bonds but no F atoms and a fluorine compound having C—F bonds but no C—H bonds may contain a compound having both C—H bonds and C—F bonds.

The fluorine compound having C—F bonds can contain F atoms in any one of forms such as the -CF group, $-CF_2$ group, and $-CF_3$ group. As the number of F atoms bonded to C atoms increases, the effect for improving the transfer efficiency tends to be large. The compound containing C—H bonds can contain H atoms in any one of forms such as the - CH group, $-CH_2$ group, and $-CH_3$ group. The combination of the fluorine compound containing C—F bonds and the compound containing C—H bonds is appropriately selected in consideration of the transfer efficiency, susceptibility to an image blur, and susceptibility to image omission, and additionally, the compatibility of the compounds, the mechanical strength of the surface layer 14 obtained by using the compounds, and the adhesion between the photoconductive layer 13 and the surface layer 14 obtained using the compound.

The above-described surface layer 14 preferably has a thickness of about 0.05 to 3 $\mu$m, and more preferably, 0.2 to 1 $\mu$m. If the surface layer 14 is excessively thick, crack readily occurs. In addition, the electrostatic interaction between the photoconductive layer 13 and toner is weakened to degrade the image quality. If the surface layer 14 is excessively thin, no sufficient mechanical strength can be obtained. When a surface layer is formed using a fluorine compound such as fluoroalkylsilane, no sufficient film thickness can be obtained in many cases. To the contrary, as described above, when a fluorine compound is mixed with a low-polarity compound such as silicone that contains no fluorine such that the ratio $N_{CF/NCH}$ falls within the above range on the exposed surface of the surface layer 14, the surface layer 14 can be made sufficiently thick.

The surface layer 14 can contain not only the above described compound but also another additive. For example, when the surface layer 14 contains fine particles of, e.g., silica, the wear resistance of the surface layer 14 can be improved. When the surface layer 14 contains an additive, the content is preferably 20 wt % or less. Normally, when the additive concentration in the surface layer 14 falls within the above range, a sufficient mechanical strength can be obtained.

The ratio $N_{CF}/N_{CH}$ need only fall within the above range on the image holding surface, and need not be constant in the direction of thickness of the surface layer 14. For example, the ratio $N_{CF}/N_{CH}$ may have a concentration gradient that increases from the interface between the photoconductive layer 13 and the surface layer 14 to the image holding surface. In this case, the adhesion of the surface layer 14 to the photoconductive layer 13 can be increased.

As is apparent from the above description, according to the present invention, the interaction between the developer forming the developer image and the image holding surface of the photosensitive body 1 is controlled. Hence, the present invention is especially effective when offset transfer scheme is employed, in which the transfer efficiency changes in accordance with the difference between an adhesion of the developer image to the photosensitive body 1 and that to the transfer roller 6.

In the above-described embodiment, developer images of four colors are formed on the image holding surface and are the n transferred. However, the developer images can be transferred in units of colors as well. In the above embodiment, a full color wet electrophotographic apparatus has been described. However, the present invention can also be applied to monochromatic w et electrophotographic apparatus.

Examples of the present invention will be described next.

EXAMPLE 1

A photosensitive body 1 shown in FIG. 2 was formed by the following method .

A member having a structure in which a conductive film 16 and photoconductive layer 13 were sequentially stacked on the outer surface of a cylindrical insulating substrate 15 was prepared. The photoconductive layer 13 was formed from an organic material prepared by dispersing a phthalocyanine pigment into polycarbonate as a binder resin.

A surface layer 14 was formed on the photoconductive layer 13 by the following procedure. First, the exposed surface of the photoconductive layer 13 was cleaned using 2-propanol. After that, high-pressure nitrogen gas is blown to dry the surface. Using a coating solution prepared in advance, a coat was formed on the photoconductive layer 13 by dip coating.

The coating solution was obtained by mixing 10 parts by weight of TOSGUARD 510 (available from Toshiba Silicone) as a silicone hardcoat agent, 2 parts by weight of XC98-B2472 (available from Toshiba Silicone) as fluoroalkylsilane, and 5 parts by weight of 2-propanol and stirring the mixed solution. The coat was formed by dip coating method while setting the pull-up rate at 5 cm/min.

The coat formed on the photoconductive layer 13 was dried with air at room temperature in an atmosphere for 5 min and was heated at 90° C. for 1 hr to harden the coat. By forming the surface layer 14 in the above-described manner, the photosensitive body 1 shown in FIG. 2 was obtained.

The thickness of the surface layer 14 formed by the above method was about 1.0 $\mu$m. The surface state of the surface layer 14 was examined using X-ray photoelectron spectroscopy (XPS, ESCA 300, Scienta). Specific measurement conditions were as follows.

Al K$\alpha$ X-ray of 4 kW was used as the incident light and was used to expose the surface layer at the angle of 15 degree from the surface. The photoelectrons generated by the X-ray were detected at the same angle of 15 degree and the chemical substances existing on the surface layer were made know.

As a consequence, the ratio $N_{CF}/N_{CH}$ of the number $N_{CF}$ of C—F bonds to the number $N_{CH}$ of C—H bonds on the exposed surface of the surface layer 14 was 30/100. The ratio $N_{CF}/N_{CH}$ tended to be high on the exposed surface side of the surface layer 14 and to be low on the side of the interface between the surface layer 14 and the photoconductive layer 13.

The photosensitive body 1 prepared by the above method was mounted in the wet electrophotographic apparatus shown in FIG. 1. A developer image formed on the image holding surface of the photosensitive body 1 using a liquid developer was transferred onto a transfer roller 6 of urethane rubber by offset transfer. As the liquid developer, a developer prepared by dispersing fine toner particles on the submicron order into ISOPAR L (available from Exxon) as a petroleum insulating solvent was used. For this transfer, both the photosensitive body 1 and transfer roller 6 were heated such that the surface temperature became 70° C. A weight of 50 kg per horizontal width of A4 paper (about 210 mm) was applied to the photosensitive body 1 by the weight of the transfer roller 6 itself and using a press roller 8.

When the developer image was transferred from the photosensitive body 1 to the transfer roller 6 by the above method, it was confirmed by comparison of weight before and after the transfer that a transfer efficiency of 100% was realized.

For the wet electrophotographic apparatus having the photosensitive body 1 formed by the above method, the degree of image omission or image blur was examined by the following method. This will be described with reference to FIGS. 3A and 3B and FIG. 4.

Figure 3A:
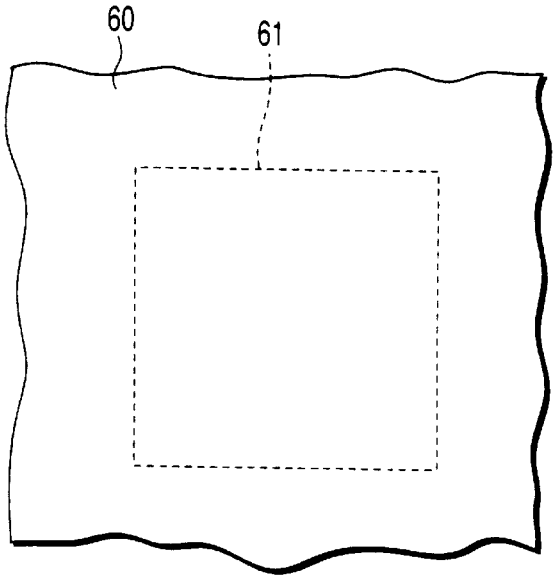
FIGS. 3A and 3B are views schematically showing an image omission and image blur that occur in a wet electrophotographic apparatus.
Figure 3B:
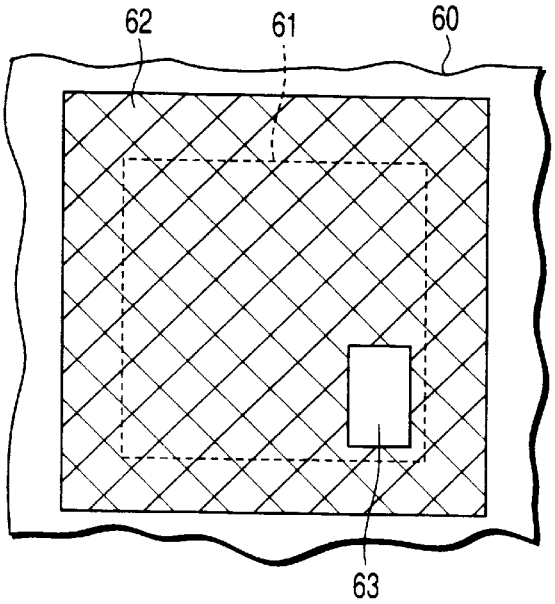

FIG. 3A schematically shows an original image corresponding to the electrostatic latent image formed on the image holding surface of the photosensitive body 1. FIG. 3B is a view schematically showing the developer image transferred onto the transfer roller 6. Referring to FIGS. 3A and 3B, reference numeral 60 denotes an image holding surface; and 61, an original image. Referring to FIG. 3B, reference numeral 62 denotes a developer image; and 63, an image-omitted portion.

Figure 4:
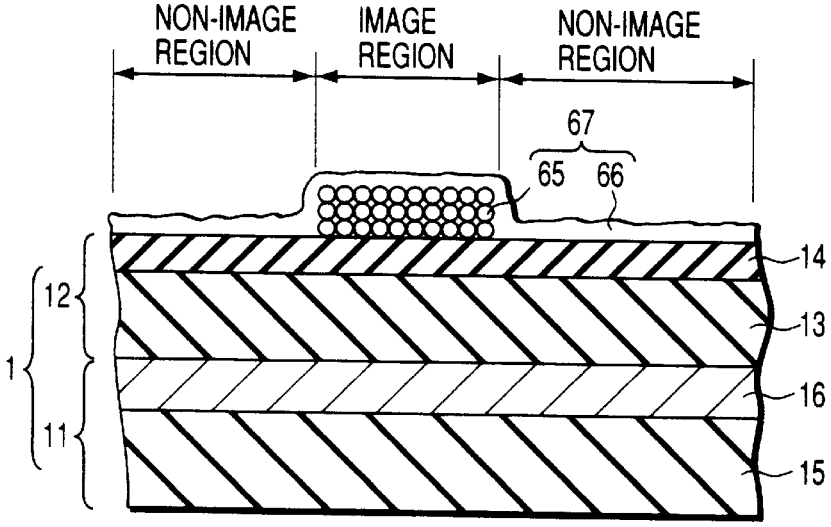
FIG. 4 is a sectional view schematically showing an electrophotographic photosensitive body according to Example 1 of the present invention, in which a developer image is formed on the image holding surface.

FIG. 4 is a sectional view schematically showing the photosensitive body according to Example 1, in which a developer image is formed on the image holding surface. Referring to FIG. 4, reference numerals 65 and 66 denote toner and a solvent, respectively. Reference numeral 67 denotes a liquid developer having the toner 65 and solvent 66. The image region shown in FIG. 4 corresponds to the original image 61 shown in FIGS. 3A and 3B, and the pattern formed by the toner 65 shown in FIG. 4 corresponds to the developer image 62 shown in FIG. 3B.

In examining the degree of image omission or image blur, first, the developer image 62 was formed on the image holding surface 60 of the photosensitive body 1, and the developer image 62 was transferred from the photosensitive body 1 to the transfer roller 6 under the same conditions as described above. Next, the developer image 62 transferred onto the transfer roller 6 was received by a computer using a scanner. After that, the data of the developer image 62 and the data of the original image 61 were compared, and an area increase rate $R_a$ of the image due to an image blur and a ratio $R_b$ of the image-omitted portion 63 were obtained. As shown in the following equations, the area increase rate $R_a$ was calculated by dividing the sum $S_d+S_b$ of the area $S_d$ of the developer image 62 and the area $S_b$ of the image-omitted portion 63 by an area $S_o$ of the original image 61 and multiplying the result by 100. The ratio $R_b$ was calculated by dividing the area $S_b$ of the image-omitted portion 63 by the area $S_o$ of the original image 61 and multiplying the result by 100.

$$R_a=100\times(S_d+S_b)/S_o$$

$$R_b=100\times S_b/S_o$$

As a result, $R_a$=102 and $R_b$=0 were obtained. More specifically, according to this example, it was confirmed that an image blur was sufficiently suppressed, and no image omission occurred.

The sufficiently high transfer efficiency can be realized without causing any image omission or image blur due to the following reason.

(1) The image holding surface 60 of the photosensitive body 1 has a sufficiently releasability capable of realizing a high transfer efficiency.

(2) The amount of the solvent 66 remaining in the non-image region of the image holding surface 60 is reduced.

(3) The image holding surface 60 has an appropriate releasability to the liquid developer 67 with respect to the electrostatic force acting between the toner 65 in the liquid developer and the image holding surface 60. These were obtained by forming the surface layer 14 such that the ratio $N_{CF}/N_{CH}$ on the image holding surface 60 satisfies the relationship represented by $$2/100<N_{CF}/N_{CH}<300/100.$$

EXAMPLE 2

A photosensitive body 1 was formed following the same procedures as that of Example 1 except that a solution prepared by mixing 10 parts by weight of TOSGUARD 510, 1 part by weight of XC98-B2472, and 5 parts by weight of 2-propanol and stirring the mixed solution was used as a coating solution for forming a surface layer 14. The thickness of the surface layer 14 of the photosensitive body 1 obtained in this way was about 1.1 μm. The surface state of the surface layer 14 was examined using XPS. The ratio $N_{CF}/N_{CH}$ of the number $N_{CF}$ of C—F bonds to the number $N_{CH}$ of C—H bonds was 10/100. The ratio $N_{CF}N_{CH}$ tended to be high on the exposed surface side of the surface layer 14 and to be low on the side of the interface between the surface layer 14 and a photoconductive layer 13.

The photosensitive body 1 prepared by the above method was mounted in the wet electrophotographic apparatus shown in FIG. 1. The transfer efficiency was examined under the same conditions as described in Example 1. As a result, a transfer efficiency of 99% was obtained, and it was confirmed that a sufficient transfer efficiency was realized although transfer properties were slightly lower than in Example 1.

An area increase rate $R_a$ of an image due to an image blur and a ratio $R_b$ of an image-omitted portion 63 were obtained following the same procedures as described in Example 1. As a result, $R_a$=103 and $R_b$=0 were obtained. More specifically, according to this example, it was confirmed that the image blur was sufficiently suppressed although it slightly increased as compared to Example 1, and no image omission occurred.

The sufficiently high transfer efficiency can be realized even in Example 2 without causing any image omission or image blur. The transfer efficiency of Example 2 is lower than that of Example 1 because the ratio $N_{CF}/N_{CH}$ of the former is lower than the ratio $N_{CF}/N_{CH}$ of the latter, i.e., the releasability of an image holding surface 60 is slightly lower in Example 2. The degree of image blur is larger in Example 2 than in Example 1 because the amount of the solvent remaining in the non-image region of the image holding surface 60 is larger in Example 2.

Figure 5:
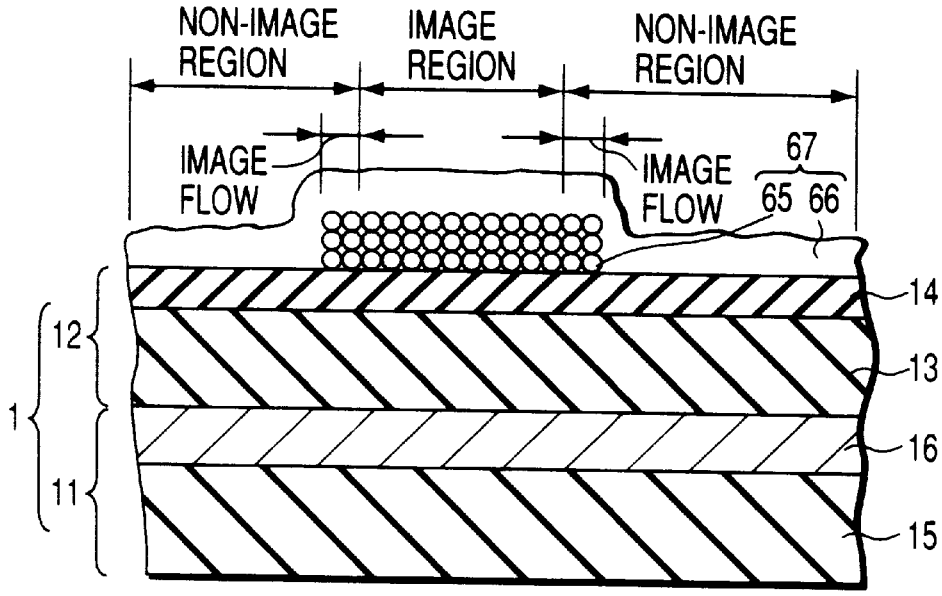
FIG. 5 is a sectional view schematically showing an electrophotographic photosensitive body according to Comparative Example 1 of the present invention, in which a developer image is formed on the image holding surface.

FIG. 5 is a sectional view schematically showing a photosensitive body according to Comparative Example 1, in which a developer image is formed on the image holding surface. A photosensitive body 1 shown in FIG. 5 had the same structure as that of the photosensitive body 1 formed in Example 1 except that the coating solution used to form a surface layer 14 was different. More specifically, the photosensitive body 1 shown in FIG. 5 was formed following the same procedure as that of Example 1 except that a solution prepared by mixing 100 parts by weight of TOSGUARD 510, 1 part by weight of XC98-B2472, and 50 parts by weight of 2-propanol and stirring the mixed solution was used as a coating solution for forming the surface layer.

COMPARATIVE EXAMPLE 1

The thickness of the surface layer 14 of the photosensitive body 1 obtained in this way was about 1.2 μm. The surface state of the surface layer 14 was examined using XPS. As a consequence, the ratio $N_{CF}/N_{CH}$ of the number $N_{CF}$ of C—F bonds to the number $N_{CH}$ of C—H bonds on the exposed surface of the surface layer 14 was 1/100.

The photosensitive body 1 was mounted in the wet electrophotographic apparatus shown in FIG. 1, and the transfer efficiency was examined under the same conditions as described in Example 1. The transfer efficiency was 80%, and no sufficient transfer efficiency was realized.

An area increase rate $R_a$ of an image due to an image blur and a ratio $R_b$ of an image-omitted portion 63 were obtained following the same procedures as described in Example 1. As a result, $R_a$=115 and $R_b$=0 were obtained. More specifically, according to this comparative example, it was confirmed that an image blur conspicuously increased as compared to Example 1 although no image omission occurred.

As described above, in Comparative Example 1, neither sufficient transfer efficiency nor sufficient suppression of the image blur could be achieved. The reason why the transfer efficiency of this comparative example is much lower than that of Example 1 is that the ratio $N_{CF}/N_{CH}$ of the former is much lower than that of the latter, i.e., the releasability of an image holding surface 60 is excessively low in this comparative example. The reason why the degree of image blur is conspicuously large in this comparative example is that the amount of solvent remaining in the non-image region of the image holding surface 60 is very large in this comparative example, as shown in FIG. 5, because the releasability of the image holding surface 60 is excessively low in this comparative example.

COMPARATIVE EXAMPLE 2

Figure 6:
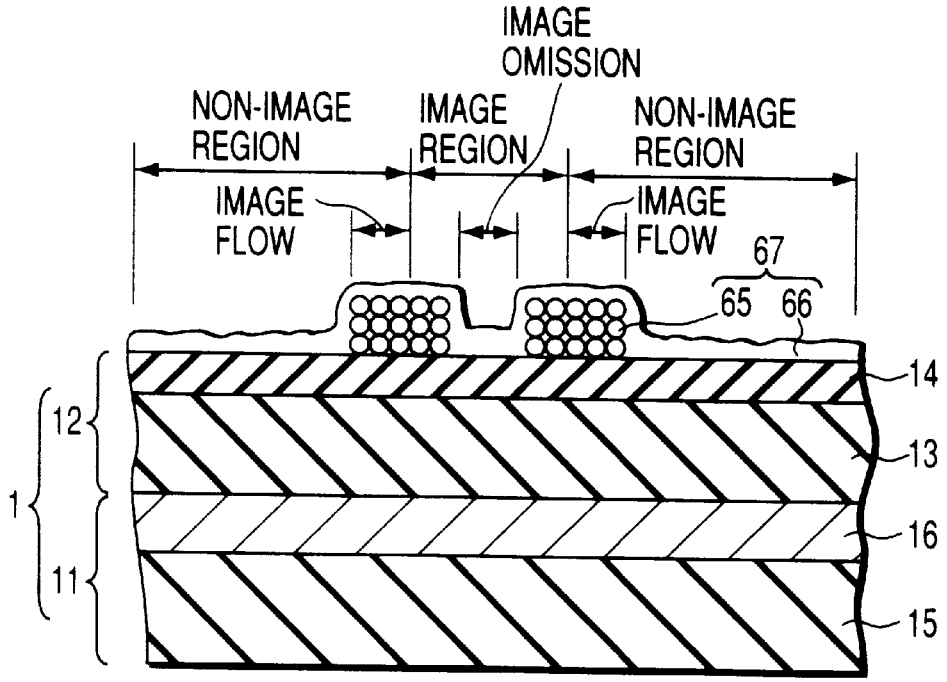
FIG. 6 is a sectional view schematically showing an electrophotographic photosensitive body according to Comparative Example 2 of the present invention, in which a developer image is formed on the image holding surface.

FIG. 6 is a sectional view schematically showing a photosensitive body according to Comparative Example 2. A photosensitive body 1 shown in FIG. 6 had the same structure as that of the photosensitive body 1 formed in Example 1 except that the coating solution used to form a surface layer 14 was different. More specifically, the photosensitive body 1 shown in FIG. 6 was formed following the same procedures as those of Example 1 except that a solution prepared by mixing 1 parts by weight of TOSGUARD 510 and 10 parts by weight of XC98-B2472 and stirring the mixed solution was used as a coating solution for forming the surface layer 14.

The film thickness of the surface layer 14 of the photosensitive body 1 obtained in this way was about 0.8 μm. The surface state of the surface layer 14 was examined using XPS. The ratio $N_{CF}/N_{CH}$ of the number $N_{CF}$ of C—F bonds to the number $N_{CH}$ of C—H bonds on the exposed surface of the surface layer 14 was 350/100.

The photosensitive body 1 was mounted in the wet electrophotographic apparatus shown in FIG. 1. The transfer efficiency was examined under the same conditions as described in Example 1. As a result, the transfer efficiency was 100%, and no sufficient transfer efficiency was realized.

An area increase rate $R_a$ of an image due to an image blur and a ratio $R_b$ of an image-omitted portion 63 were obtained following the same procedures as described in Example 1. As a result, $R_a$=120 and $R_b$=15 were obtained. More specifically, according to this comparative example, both the image blur and image omission conspicuously increased as compared to Example 1.

As described above, in this comparative example, although a sufficient transfer efficiency was obtained, sufficient suppression of the image blur and sufficient suppression of the image omission were not achieved. The reason for this is that the releasability of an image holding surface 60 becomes excessively large with respect to the electrostatic force acting between toner 65 and the image holding surface 60, and the toner 65 is repelled from the image holding surface 60 because the ratio $N_{CF}/N_{CH}$ is excessively high in this comparative example.

As described above, in wet electrophotography, it is conventionally difficult to realize a sufficiently high transfer efficiency without causing any image omission or image blur because of use of a liquid developer. However, the present invention allows to realize a sufficiently high transfer efficiency without causing any image omission or image blur in wet electrophotography by a very simple method of introducing C—F bonds and C—H bonds on the image holding surface of the photosensitive body at a predetermined ratio. More specifically, according to the present invention, in wet electrophotography, an electrophotographic photosensitive body and wet electrophotographic apparatus, which can realize a sufficiently high transfer efficiency without causing any image omission or image blur, and in other words, an electrophotographic photosensitive body and wet electrophotographic apparatus, which enable to realize a satisfactory image quality, are provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophotographic photosensitive body used in a wet electrophotographic apparatus, comprising:

a substrate having a conductive surface; and a photosensitive layer formed on the conductive surface of the substrate and changing in a charged state upon being irradiated with light, the photosensitive layer having, on an exposed surface, C—F bonds and C—H bonds for which the ratio of the number $N_{CF}$ of C—F bonds to the number $N_{CH}$ of C—H bonds satisfies, on the exposed surface of the photosensitive layer, a relationship represented by $$2/100<N_{CF}/N_{CH}<300/100,$$

wherein the photosensitive layer comprises a photoconductive layer formed on the conductive surface of the substrate and changing in a charged state upon being irradiated with light, and a surface layer formed on the photoconductive layer and having the exposed surface, and wherein the exposed surface contains a fluorosilicone resin and a silicone resin.

2. A body according to claim 1, wherein the ratio $N_{CF}/N_{CH}$ on the exposed surface side of the surface layer is higher than the ratio $N_{CF}/N_{CH}$ on a side of the surface layer at the interface between said surface layer and the photoconductive layer.

3. A body according to claim 1, wherein the ratio $N_{CF}/N_{CH}$ satisfies, on the exposed surface of the photosensitive layer, a relationship represented by $$5/100<N_{CF}/N_{CH}<100/100.$$

4. A body according to claim 1, wherein the surface layer has a thickness of 0.05 to 3 $\mu$m.

5. A wet electrophotographic apparatus comprising; an electrophotographic photosensitive body having an image holding surface comprising a substrate having a conductive surface, and a photosensitive layer formed on the conductive surface of the substrate and changing in a charged state upon being irradiated with light, an exposed surface of the photosensitive layer constituting the image holding surface, C—F bonds and C—H bonds existing on the image holding surface for which the ratio of the number $N_{CF}$ of C—F bonds to the number Ncl of C—H bonds satisfies, on the image holding surface, a relationship represented by $$2/100<N_{CF}/N_{CH}<300/100,$$

a latent image formation unit forming a latent image on the image holding surface;

a developing unit forming a developer image on the image holding surface having the latent image using a liquid developer; and a transfer unit transferring the developer image from the image holding surface onto a recording medium, wherein the photosensitive layer comprises a photoconductive layer formed on the conductive surface of the substrate and changing in a charged state upon being irradiated with light, and a surface layer formed on the photoconductive layer and having the exposed surface, wherein the exposed surface contains a fluorosilicone resin and a silicone resin.

6. An apparatus according to claim 5, wherein the ratio $N_{CF}/N_{CH}$ on the exposed surface side of the surface layer is higher than the ratio $N_{CF}/N_{CH}$ on a side of the surface layer at the interface between said surface layer and the photoconductive layer.

7. An apparatus according to claim 5, wherein the ratio $N_{CF}/N_{CH}$ satisfies, on the exposed surface of the photosensitive layer, a relationship represented by $$5/100<N_{CF}/N_{CH}<100/100.$$

8. An apparatus according to claim 5, wherein the surface layer has a thickness of 0.05 to 3 $\mu$m.

9. An apparatus according to claim 5, wherein the apparatus is a full color wet electrophotographic apparatus.

10. An apparatus according to claim 5, wherein the transfer unit transfers the developer image from the image holding surface onto the recording medium using pressure.

11. An apparatus according to claim 5, wherein the transfer unit transfers the developer image from the image holding surface onto the recording medium using pressure and heat.

12. An apparatus according to claim 5, wherein the transfer unit comprises an intermediate transfer medium mediating transfer of the developer image formed on the image holding surface onto the recording medium.

13. An electrophotographic photosensitive body used in a wet electrophotographic apparatus, comprising:

a substrate having a conductive surface, and a photosensitive layer formed on the conductive surface of the substrate and changing in a charged state upon being irradiated with light, the photosensitive layer having, on an exposed surface, C—F bonds and C—H bonds for which the ratio of the number $N_{CF}$ of C—F bonds to the number $N_{CH}$ of C—H bonds satisfies, on the exposed surface of the photosensitive layer, a relationship represented by $$2/100<N_{CF}/N_{CH}<300/100,$$

wherein the photosensitive layer comprises a photoconductive layer formed on the conductive surface of the substrate and a surface layer formed on the photoconductive layer and having the exposed surface, and wherein the ratio $N_{CF}/N_{CH}$ on the exposed surface side of the surface layer is higher than the ratio $N_{CF}/N_{CH}$ on a side of the surface layer at the interface between said surface layer and the photoconductive layer.

14. A body according to claim 13, wherein the ratio $N_{CF}/N_{CH}$ satisfies, on the exposed surface of the photosensitive layer, a relationship represented by $$5/100<N_{CF}/N_{CH}<100/100.$$

15. A body according to claim 14, wherein the surface layer has a thickness of 0.05 to 3 $\mu$m.

16. A wet electrophotographic apparatus comprising; an electrophotographic photosensitive body having an image holding surface comprising a substrate having a conductive surface, and a photosensitive layer formed on the conductive surface of the substrate and changing in a charged-state upon being irradiated with light, an exposed surface of the photosensitive layer constituting the image holding surface, C—F bonds and C—H bonds existing on the image holding surface for which the ratio of the number $N_{CF}$ of C—F bonds to the number $N_{CH}$ of C—H bonds satisfies, on the image holding surface, a relationship represented by $$2/100<N_{CF}/N_{CH}<300/100,$$

a latent image formation unit forming a latent image on the image holding surface;

a developing unit forming a developer image on the image holding surface having the latent image using a liquid developer; and a transfer unit transferring the developer image from the image holding surface onto a recording medium, wherein the photosensitive layer comprises a photoconductive layer formed on the conductive surface of the substrate and a surface layer formed on the photoconductive layer and having the exposed surface, and wherein the ratio $N_{CF}/N_{CH}$ on the exposed surface side of the surface layer is higher than the ratio $N_{CF}/N_{CH}$ on a side of the surface layer at the interface between said surface layer and the photoconductive layer.

17. An apparatus according to claim 16, wherein the ratio $N_{CF}/N_{CH}$ satisfies, on the exposed surface of the photosensitive layer, a relationship represented by $$5/100<N_{CF}/N_{CH}<100/100.$$

18. An apparatus according to claim 17, wherein the surface layer has a thickness of 0.05 to 3 $\mu$m.

19. An apparatus according to claim 16, wherein the apparatus is a full color wet electrophotographic apparatus.

20. An apparatus according to claim 16, wherein the transfer unit transfers the developer image from the image holding surface onto the recording medium using pressure.

21. An apparatus according to claim 16, wherein the transfer unit transfers the developer image from the image holding surface onto the recording medium using pressure and heat.

22. An apparatus according to claim 16, wherein the transfer unit comprises an intermediate transfer medium mediating transfer of the developer image formed on the image holding surface onto the recording medium.

* * * * *